US008047628B2

(12) United States Patent
Niimi

(10) Patent No.: US 8,047,628 B2
(45) Date of Patent: Nov. 1, 2011

(54) PRINTING APPARATUS

(75) Inventor: Akiko Niimi, Kasugai (JP)

(73) Assignee: Brother Kogyo Kabushiki Kaishi, Nagoya (JP)

( * ) Notice: Subject to any disclaimer, the term of this patent is extended or adjusted under 35 U.S.C. 154(b) by 340 days.

(21) Appl. No.: 12/382,335

(22) Filed: Mar. 13, 2009

(65) Prior Publication Data

US 2009/0244123 A1 Oct. 1, 2009

(30) Foreign Application Priority Data

Mar. 31, 2008 (JP) ..... 2008-093060

(51) Int. Cl.
*B41J 2/165* (2006.01)

(52) U.S. Cl. ..... 347/30

(58) Field of Classification Search ..... 347/22, 347/29, 30, 84, 85
See application file for complete search history.

(56) References Cited

U.S. PATENT DOCUMENTS 6,276,784 B1 8/2001 Ikkatai et al.
6,517,189 B2 * 2/2003 Ogawa et al. ..... 347/35
7,621,626 B2 * 11/2009 Umeda ..... 347/85
2002/0126175 A1 9/2002 Shima
2003/0020788 A1 1/2003 Asano

FOREIGN PATENT DOCUMENTS

EP 0 872 346 A1 10/1998
JP A-2003-39690 2/2003
JP A-2004-9685 1/2004

OTHER PUBLICATIONS

Dec. 4, 2009 Search Report issued in European Patent Application No. 09155593.8.

* cited by examiner

*Primary Examiner* — An Do
(74) *Attorney, Agent, or Firm* — Oliff & Berridge, PLC

(57) ABSTRACT

A printing apparatus to form an image on a recording medium is provided. The printing apparatus includes a recording head, an ink cartridge, which contains the ink therein, an ink cartridge storage to store the ink cartridge, an ink conveyer tube, which connects the recording head and the ink cartridge to convey the ink, and a maintenance system having an aspirator to aspirate the ink to be drawn in the recording head and the ink conveyer tube and a cap to cover a nozzle surface of the recording head, and a releasing system, which is arranged in the ink conveyer tube to switch an open state and a closed state. The releasing system is arranged in a position higher than a position of the ink cartridge so that the releasing system and the ink cartridge have a predetermined water head difference therebetween.

18 Claims, 15 Drawing Sheets

PRINTING APPARATUS

CROSS REFERENCE TO RELATED APPLICATION

This application claims priority from Japanese Patent Application No. 2008-093060, filed on Mar. 31, 2008, the entire subject matter of which is incorporated herein by reference.

BACKGROUND

1. Technical Field

An aspect of the present invention relates to a printing apparatus, specifically to a printing apparatus to print in ink containing solid component, which may be deposited in the ink, and concentration gradient may occur therein.

2. Related Art

Conventionally, an inkjet printer to form an image in white ink, in addition to the other colored inks (e.g., cyan, magenta, yellow, and black), has been suggested. The white ink generally contains oxidized titanium and therefore has specifically higher density of colorant with respect to densities of colorants in the other colored inks. Further, a particle size of the white colorant is larger. Therefore, the colorant in the white ink can be easily deposited inside an ink tube.

Accordingly, the densities of the white ink may vary within the tube, and troubles such as irregular ejection of the ink from an inkjet head, insufficient flow of the ink flow to the inkjet head, or uneven densities of the color in a formed image can be caused due to the uneven distribution of the ink within the tube.

Therefore, an inkjet printer with white ink is generally provided with a mechanism to prevent deposition of the colorant in the white ink. For example, Japanese Patent Provisional Publication No. 2004-009685 discloses an inkjet printer having an ink path, in which ink inside an ink cartridge is circulated so that the ink is stirred and smoothly conveyed.

For another example, Japanese Patent Provisional Publication No. 2003-39690 discloses an ink cartridge for an inkjet printer having an stirrer equipment and a vibrator equipment to periodically stir the ink therein.

SUMMARY

In the above inkjet printing apparatuses, however, the dedicated equipments and controlling systems to control behaviors of the equipments often require a large space and may increase cost for the entire printing apparatuses. If the deposition of the colorant in the ink is to be prevented without such equipments, instead, a head cleaning operation to replace the ink remaining in an ink supplying system with freshly stirred ink in the ink cartridge is required. However, such an operation to replace the remaining ink in the entire ink supplying system including tubes and an inkjet head waste a large amount of ink, which is not beneficial in cost-effectiveness and an ecological reason.

In view of the above drawbacks, the present invention is advantageous in that a printing apparatus, in which unevenness of the ink in the ink supplying system can be reduced and concentration gradient of the ink within the ink supplying system can be smaller, without a space-consuming equipment, is provided.

According to an aspect of the present invention, a printing apparatus to form an image on a recording medium according to print data representing the image is provided. The printing apparatus includes a recording head, which ejects ink onto the recording medium, an ink cartridge, which contains the ink therein, an ink cartridge storage to store the ink cartridge, an ink conveyer tube, which connects the recording head and the ink cartridge to convey the ink, a maintenance system having an aspirator to aspirate the ink to be drawn in the recording head and the ink conveyer tube and a cap to cover a nozzle surface of the recording head when the ink in the recording head and the ink conveyer tube is aspirated, and a releasing system, which is arranged in the ink conveyer tube to switch an open state in which air flow in the ink conveyer tube is released and a closed state in which the air flow in the ink conveyer tube is shut down. The releasing system is arranged in a position higher than a position of the ink cartridge so that the releasing system and the ink cartridge have a predetermined water head difference therebetween.

According to the above configuration, when the air flow in the ink conveyer tube is released by the releasing system, the water head difference between the releasing system and the ink cartridge substantially large to collect the ink remaining in the ink conveyer tube to be withdrawn in the ink cartridge. Thus, the ink in the ink conveyer tube can be prevented from being left in the ink conveyer tube to be deposited.

BRIEF DESCRIPTION OF THE ACCOMPANYING DRAWINGS

DETAILED DESCRIPTION

Figure 1:
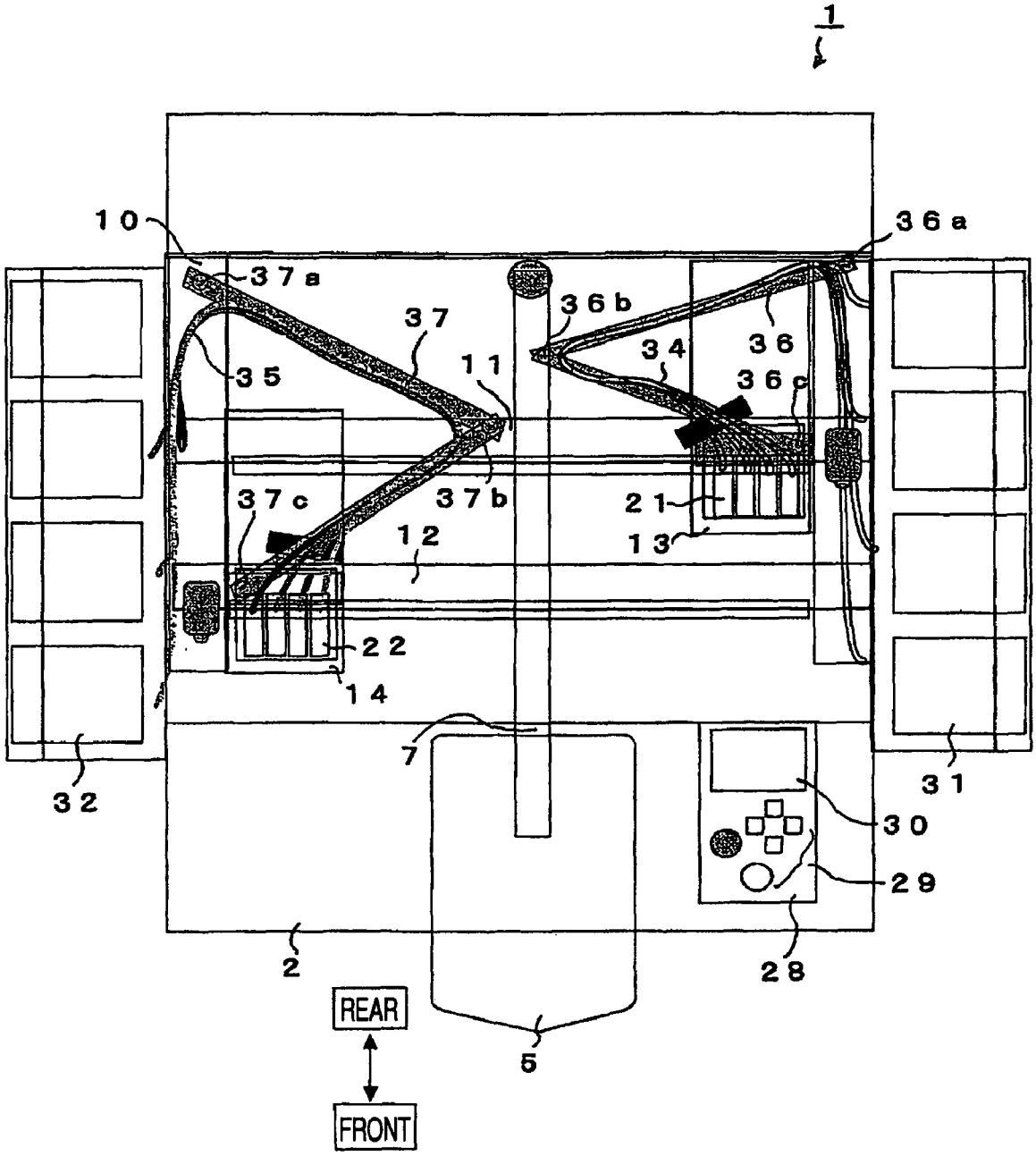
FIG. 1 is a plane view of an inkjet printer according to an embodiment of the present invention.
Figure 2:
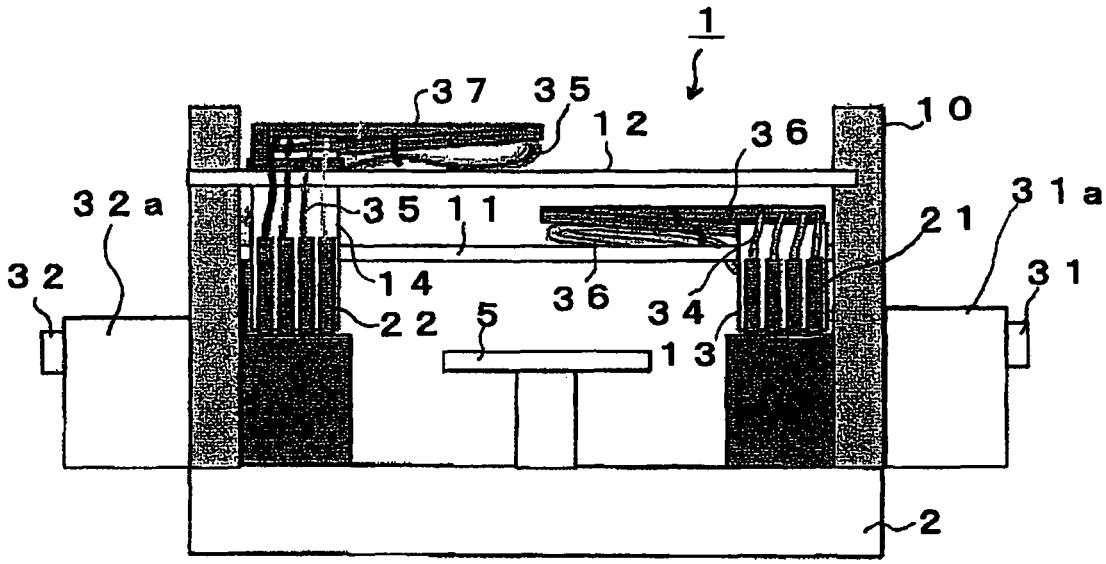
FIG. 2 is a front view of the inkjet printer according to the embodiment of the present invention.
Figure 3:
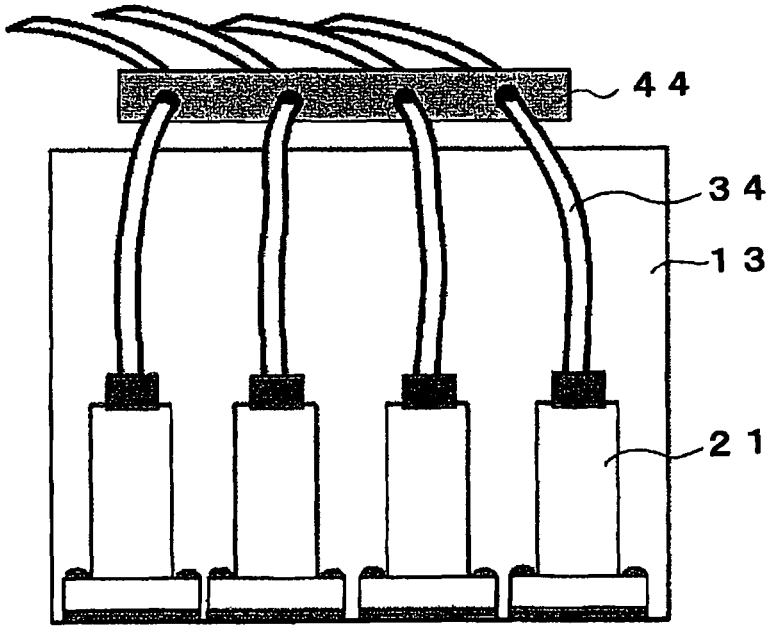
FIG. 3 is a front view of inkjet heads and a release valve in the inkjet printer according to the embodiment of the present invention.
Figure 4A:
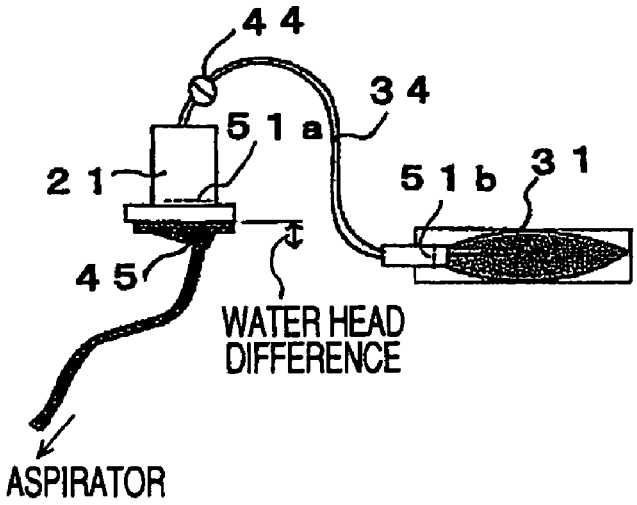
FIGS. 4A and 4B illustrate an ink collecting operation of the release valve in the inkjet printer according to the embodiment of the present invention.
Figure 4B:
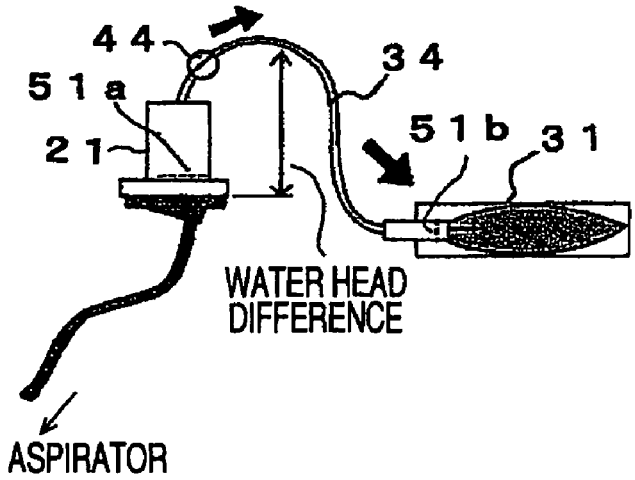
Figure 5:
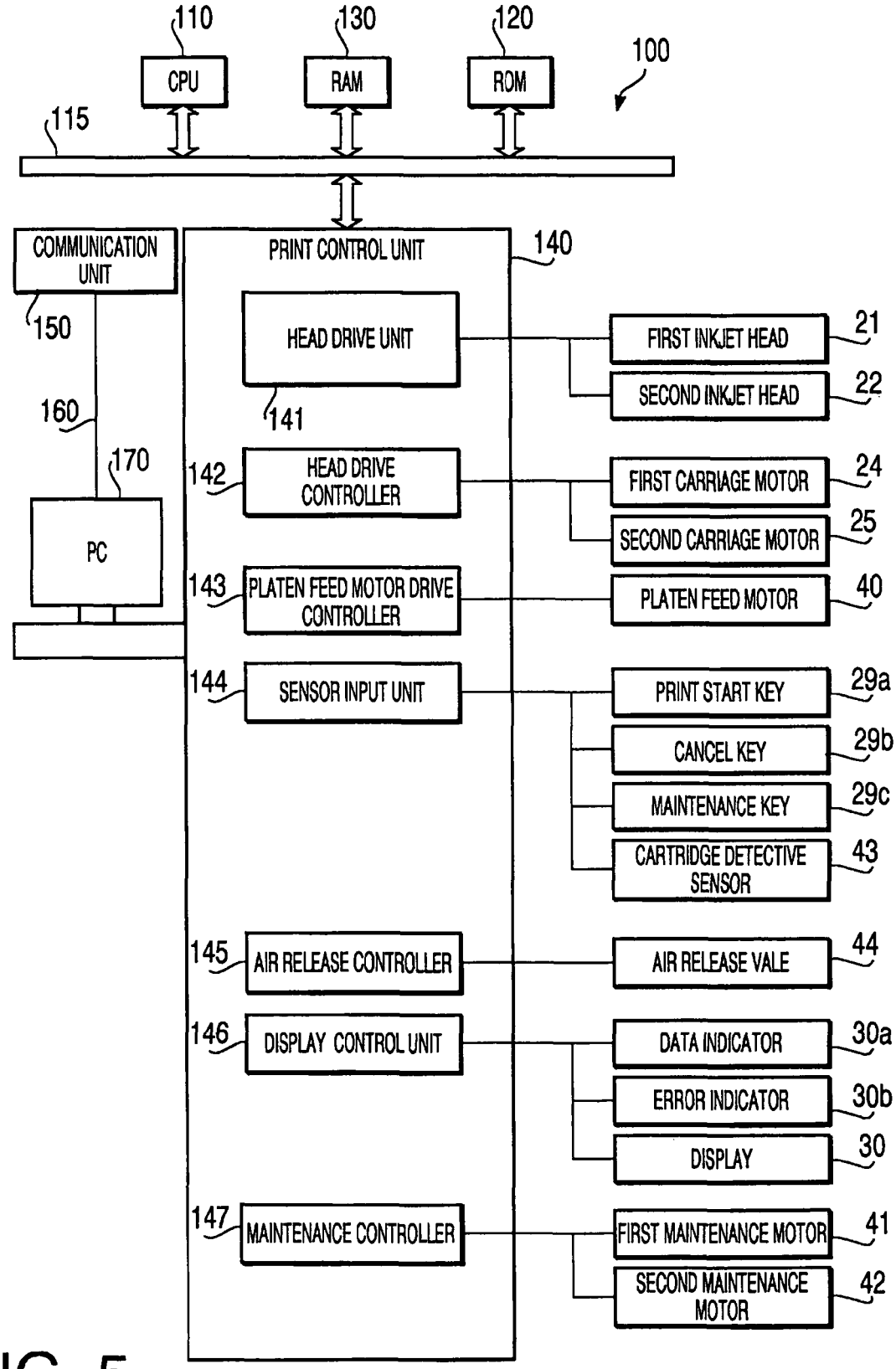
FIG. 5 is a block diagram to illustrate an electric configuration of the inkjet printer according to the embodiment of the present invention.
Figure 6:
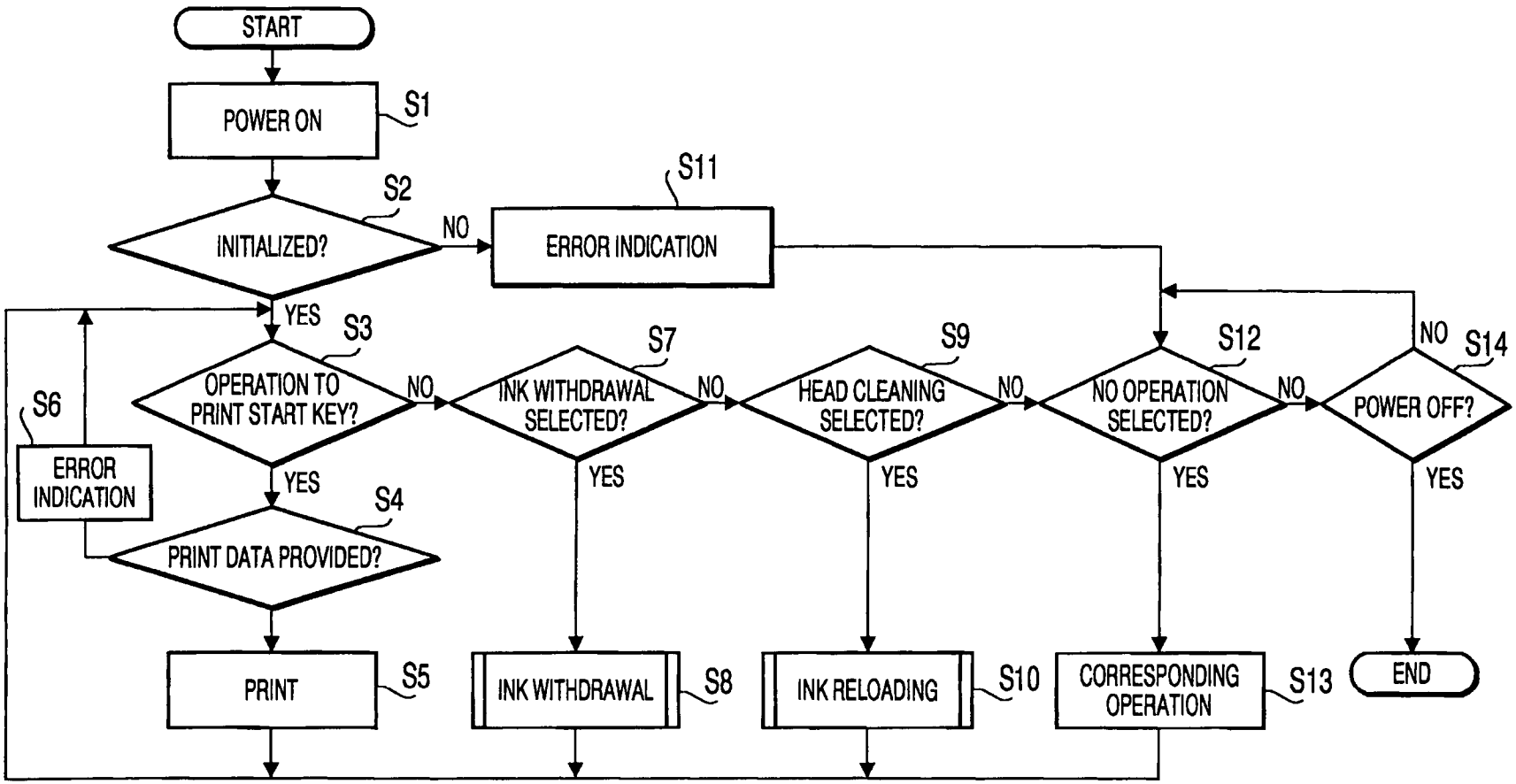
FIG. 6 is a flowchart to illustrate a main flow of the operation of the inkjet printer according to the embodiment of the present invention.

Hereinafter, an embodiment according to an aspect of the present invention will be described with reference to the accompanying drawings. FIG. 1 is a plane view of an inkjet printer 1 according to the embodiment of the present invention. FIG. 2 is a front view of the inkjet printer 1 according to the embodiment of the present invention. FIG. 3 is a front view of inkjet heads and a release valve in the inkjet printer 1 according to the embodiment of the present invention. FIGS. 4A and 4B illustrate an ink collecting operation of the release valve in the inkjet printer 1 according to the embodiment of the present invention. FIG. 5 is a block diagram to illustrate an electric configuration of the inkjet printer 1 according to the embodiment of the present invention. FIG. 6 is a flowchart to illustrate a main flow of the operation of the inkjet printer 1 according to the embodiment of the present invention.

The inkjet printer 1 in the present embodiment is configured to be an inkjet printer having first inkjet heads 21 and second inkjet heads 22 to form an image on a recording medium in inks ejected from nozzle surfaces of the first and the second inkjet heads 21, 22 according to image data. In the inkjet printer 1, a piece of fabric can be used as a recording medium, and the piece of fabric may be, for example, a T-shirt. As shown in FIGS. 1 and 2, the inkjet printer 1 is provided with a flat base plate 2 at a bottom and a chassis 10 to cover the entire body of the inkjet printer 1.

The first inkjet heads 21 are mounted on a carriage 13, which is reciprocated in a right-and-left direction in FIG. 1 along a guide rail 11. In the vicinity of a right-hand end of the guide rail 11, a first carriage motor 24 (FIG. 5) to carry the first inkjet heads 21 is provided. Further, a pulley (not shown) is provided in the vicinity of a left-hand end of the guide rail 1, and a carriage belt (not shown) is drawn between the first carriage motor 24 and the pulley. The carriage belt is fixed to the carriage 13 so that the carriage 13 is reciprocated along the guide rail 11 in the right-and-left direction (i.e., the main scanning direction) when the first carriage motor 24 is activated. At one of the right-hand end and the left-hand end of the reciprocative range of the carriage 13, a maintenance mechanism (not shown) such as a capping unit and a purge unit for the first inkjet heads 21 is provided.

On the right-hand end of the chassis 10, first ink cartridges 31 containing white ink therein are detachably attached. The first ink cartridges 31 are connected to each of the inkjet heads 21 by flexible ink conveyer tubes 34 so that the inks stored in the first ink cartridges 31 are conveyed to each channel of the inkjet heads 21. According to the present embodiment, all of the inkjet heads 21 are provided to discharge white ink therefrom, and the first ink cartridges 31 respectively contain white ink.

The ink conveyer tubes 34 to supply the ink to the first inkjet heads 21 are moved along with first inkjet heads 21 when the carriage 13 with the first inkjet heads 21 is reciprocated in the main scanning direction. Therefore, the ink conveyer tubes 34 are formed to be longer than a length of the guide rail 11. The ink conveyer tubes 34 with the length are held by a first arm 36 to extend there-along so that the ink conveyer tubes 34 can smoothly move to follow the carriage 13.

The first arm 36 includes a rear portion, which is a thin and elongated plate rotatable about a supporting point 36*a*, and a supporting point 36*b* is provided at an end of the rear portion. The first arm 36 further includes a front portion, which is a thin and elongated plate rotatable about the supporting point 36*b* and is coupled to the carriage 13 at a supporting point 36*c*.

The inkjet printer 1 according to the embodiment is equipped with a guide rail 12 (FIG. 1), which is arranged in parallel with the guide rail 11, to guide a carriage 14 with a second inkjet head 22 being mounted. As shown in FIG. 2, the guide rail 12 is arranged in a position higher than the guide rail 11.

In the vicinity of a left-hand end of the guide rail 12, a second carriage motor 25 (FIG. 5) to carry the second inkjet heads 22 is provided. Further, a pulley (not shown) is provided in the vicinity of the right-hand end of the guide rail 12, and a carriage belt (not shown) is drawn between the second carriage motor 25 and the pulley. The carriage belt is fixed to the carriage 14 so that the carriage 14 is reciprocated along the guide rail 12 in the left-and-right direction (i.e., the main scanning direction) when the second carriage motor 25 is activated. At one of the right-hand end and the left-hand end of the reciprocative range of the carriage 14, a maintenance mechanism (not shown) such as a capping unit and a purge unit for the second inkjet heads 22 is provided.

On the left-hand end of the chassis 10, second ink cartridges 32 containing CMYK (cyan, magenta, yellow, and black) colored inks respectively therein are detachably attached. The second ink cartridges 32 are connected to each of the inkjet heads 22 by flexible ink conveyer tubes 35 so that the inks stored in the second ink cartridges 32 are conveyed to each channel of the inkjet heads 22. According to the present embodiment, each of the inkjet heads 22 discharges C, M, Y, K inks therefrom respectively.

The ink conveyer tubes 35 to supply the ink to the second inkjet heads 22 are moved along with second inkjet heads 22 when the carriage 14 with the second inkjet heads 22 is reciprocated in the main scanning direction. Therefore, the ink conveyer tubes 35 are formed to be longer than a length of the guide rail 12. The ink conveyer tubes 35 with the length are held by a second arm 37 to extend there-along so that the ink conveyer tubes 35 can smoothly move to follow the carriage 14.

The second arm 37 includes a rear portion, which is a thin and elongated plate, rotatable about a supporting point 37*a*, and a supporting point 37*b* is provided at an end of the rear portion. The second arm 37 further includes a front portion, which is a thin and elongated plate, rotatable about the supporting point 37*b* and is coupled to the carriage 14 at a supporting point 37*c*.

It is to be noted that the guide rail 12 is arranged in the position vertically higher than the guide rail 11; therefore, movements of the first arm 36 and the second arm 37 do not interfere each other even when the second arm 37 moves to cross over the first arm 36.

The inkjet printer 1 is equipped with a platen 5. The platen 5 is formed to have a substantially rectangular-shaped plate, on which the recording medium (e.g., a T-shirt) is placed in a printable posture in the inkjet printer 1. The platen 5 is supported by a platen feed unit 7, which includes a guide rail (not shown) and a platen feed motor 40 (FIG. 4) being a stepping motor arranged at a rear end portion (i.e., upper end in FIG. 1) of the guide rail. When the platen feed motor 40 is activated, the platen 5 is reciprocated along the guide rail in the front-and-rear direction (i.e., up-and-down direction) in FIG. 1. The inkjet printer 1 may have a plurality of sizes of platen 5, which can be selected according to, for example, sizes and shapes of the recording media.

At right-hand front of the inkjet printer 1 is provided an operation panel 28, through which a user inputs an instruction for the inkjet printer 1. The operation panel 28 includes print buttons 29 and a display 30.

Next, a fluid releasing mechanism according to the present embodiment will be described with reference to FIG. 3. The inkjet printer 1 in the present embodiment is equipped with an air release valve 44, which releases and shuts down air flow in the ink conveyer tubes 34. As has been mentioned above, the ink conveyer tubes 34 connect the first ink cartridges 31 and the channels of the inkjet heads 21 to convey the white ink. The air release valve 44 is an electromagnetic valve, which is switched from an open position and a closed position, and vice versa, to release and shut down the air flow in between the first inkjet heads 21 and the first ink cartridges 31 in the ink conveyer tubes 34, according to electric signals. When the air release valve 44 is opened to release the air flow in the ink conveyer tubes 34 with the first inkjet heads 21 being covered with caps 45 (see FIG. 4A) in the maintenance unit, the ink remaining in the ink conveyer tubes 34 is withdrawn in the first ink cartridges 31.

As shown in FIG. 4A, when the caps 45 cover the nozzle surfaces of the first inkjet heads 21, and the air release valve 44 is switched to shut down the air flow in the ink conveyer tubes 34, a water head difference between a level of the nozzle surfaces of the first inkjet heads 21 and an ink supplying level (i.e., vertical positions of the first ink cartridges 31) is substantially small so that the ink remaining in the ink conveyer tubes 34 is not withdrawn in the first ink cartridges 31.

However, as shown in FIG. 4B, when the caps 45 cover the nozzle surfaces of the first inkjet heads 21, and the air release valve 44 is switched to release the air flow in the ink conveyer tubes 34, the water head difference between a level of the air release valve 44 and the ink supplying level of the first ink cartridges 31 is substantially large so that the ink remaining in the ink conveyer tubes 34 is withdrawn in the first ink cartridges 31. The air release valve 44 is switched to be opened and closed according to predetermined timings in an ink reloading process, which will be described later in detail.

In the present embodiment, the water head difference between the levels of the air release valve 44 and the ink supplying level of the first ink cartridges 31 is approximately 100 mm. Therefore, when the air release valve 44 is switched to release the air flow in the ink conveyer tubes 34, the water head difference grows to be larger so that the remaining ink can be substantially withdrawn. However, it is to be noted that the water head difference is not limited to 100 mm, but may be any height greater than 20 mm with respect to the ink supplying level of the first ink cartridges 31.

It is to be noted in the present embodiment that the first ink cartridges 31 are provided with filters 51b, and the first inkjet heads 21 are provided with filters 51*a* at positions indicated by dotted lines in FIGS. 4A and 4B. These filters 51*a*, 51*b* serve to catch obstacles flowing in the ink when the ink is collected.

Next, referring to FIG. 5, an electrical configuration of the inkjet printer 1 will be described. FIG. 4 is a block diagram showing the electrical configuration of the inkjet printer 1 according to the present embodiment of the invention. As shown in FIG. 5, the inkjet printer 1 is provided with a control unit 100, and the control unit 100 includes a CPU 110 that controls the entire operation in the inkjet printer 1. The CPU 110 is connected with a ROM 120, a RAM 130 through a bus 115. The ROM 120 stores various controlling programs to be executed in the CPU 110. The RAM 130 temporarily stores data concerning the operations in the inkjet printer 1.

The CPU 110 is further connected with a communication unit 150 and with a PC (personal computer) 170 through a communication cable 160. Furthermore, the CPU 110 is connected with a print control unit 140 to control printing operations in the inkjet printer 1 through the bus 115.

The print control unit 140 includes a head controller 141, which drives piezoelectric actuators for each of the channels in the first inkjet heads 21 and the second inkjet heads 22. The print control unit 140 further includes a head drive controller 142 to activate the first carriage motor 24 and the second carriage motor 25, and a platen feed motor controller 143 to activate the platen feed motor 40.

The print control unit 140 further includes a sensor input unit 144, which receives input signals provided by a print start key 29*a*, a cancel key 29*b*, a maintenance key 29*c*, and a cartridge detective sensor 43. The print start key 29*a*, the cancel key 29*b*, and the maintenance key 29*c* are provided on the operation panel 28 (see also FIG. 7A). The operation panel 28 further includes a data reception indicator 30*a*, an error indicator 30*b*, and the display 30, which are controlled by a display control unit 145. The print control unit 140 further includes a fluid release controller 145 to control motions of the air release valve 44.

The inkjet printer 1 in the present embedment includes a first maintenance mechanism and a second maintenance mechanism respectively on either (right or left) side of the guide rail 11 and the guide rail 12. The first and the second maintenance mechanisms serve to maintain operating conditions of the first inkjet heads 21 and the second inkjet heads 22 respectively. The first maintenance mechanism includes a first maintenance motor 41, and the second maintenance mechanism includes a second maintenance motor 42. The print control unit 140 is provided with a maintenance controller 147 to activate the first maintenance motor 41 and the second maintenance motor 42.

Next, a main flow of the operation of the inkjet printer 1 according to the embodiment of the present invention will be described with reference to FIG. 6. When the inkjet printer 1 is powered on and the operation starts in S1, the inkjet printer 1 is initialized. The initialization includes, for example, a flushing operation to prepare the nozzles of the first and the second inkjet heads 21, 22 in condition for ejecting ink drops. In S2, determination is made as to whether the initialization successfully completed. When the initialization fails (S2: NO), in S11, the error indicator 30*b* is activated. When the error indicator 30*b* is activated, for example, an indicator lamp is lit and/or an error indicating sound is generated.

Following S11, in S12, it is examined as to whether one of operation menus, which exclude "print," "ink withdrawal," and "head cleaning," is selected. When one of the operation menus is selected (S12: YES), in S13, an operation corresponding to the selection is performed. Thereafter, the inkjet printer 1 waits for next input to select an operation menu.

In S12, if no operation menu is selected (S12: NO), in S14, it is examined as to whether power to the inkjet printer 1 is shut off. If power to the inkjet printer 1 is shut off (S14: YES), the operation is terminated. If the power supply to the inkjet printer 1 is maintained (S14: NO), the process repeats S12.

In S2, when the initialization successfully completes (S2: YES), the inkjet printer 1 waits for selection of an operation menu to be entered. In S3, it is examined as to whether the print start key 29*a* has been operated. If the print start key 29*a* has been operated (S3: YES), in S4, it is examined as to whether the inkjet printer 1 is provided with print data. If no print data has been provided (S4: NO), in S6, an error is indicated, and the process returns to S3. If the inkjet printer 1 is provided with print data (S4: YES), in S5, a printing operation to print an image according to the print data is performed. The process returns to S3 thereafter.

In S3, if the print start key 29*a* has not been operated (S3: NO), in S7, it is examined as to whether an ink withdrawal operation is selected through a menu window displayed in the operation panel 28. If selection for the ink withdrawal operation is made (S7: YES), in S8, the ink remaining in the ink conveyer tubes 34 is withdrawn in the first ink cartridges 31. The process returns to S3 thereafter. The ink withdrawal operation will be described later in detail.

In S7, if selection for the ink withdrawal operation is not made (S7: NO), in S9, it is examined as to whether selection for a head cleaning operation is made. If selection for the head cleaning operation is made (S9: YES), in S10, an ink reloading operation is performed, and the ink conveyer tubes 34, from which the remaining ink has been unloaded, is reloaded. The process returns to S3 thereafter. The ink reloading operation will be described later in detail.

Figure 7A:
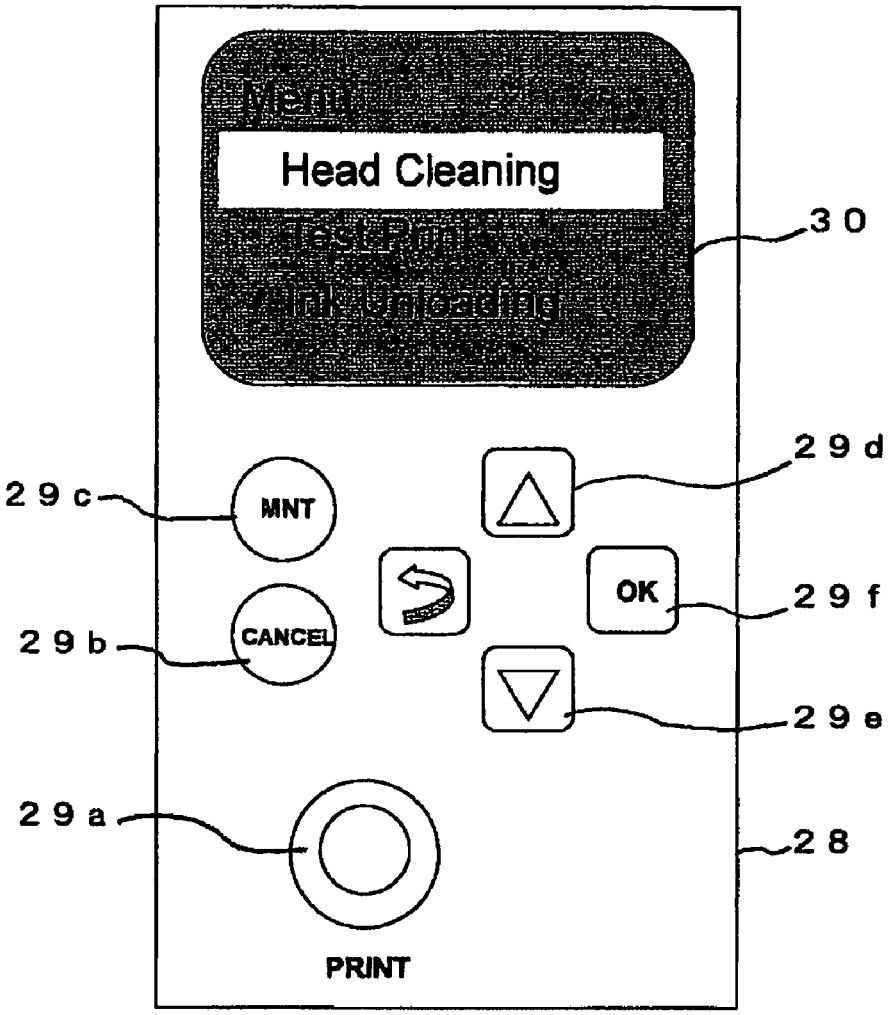
FIGS. 7A and 7B are diagrams to illustrate an operation indicator panel in the inkjet printer according to the embodiment of the present invention.
Figure 7B:
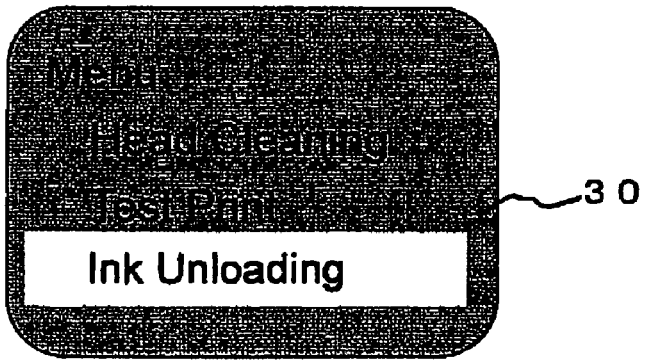
Figure 8:
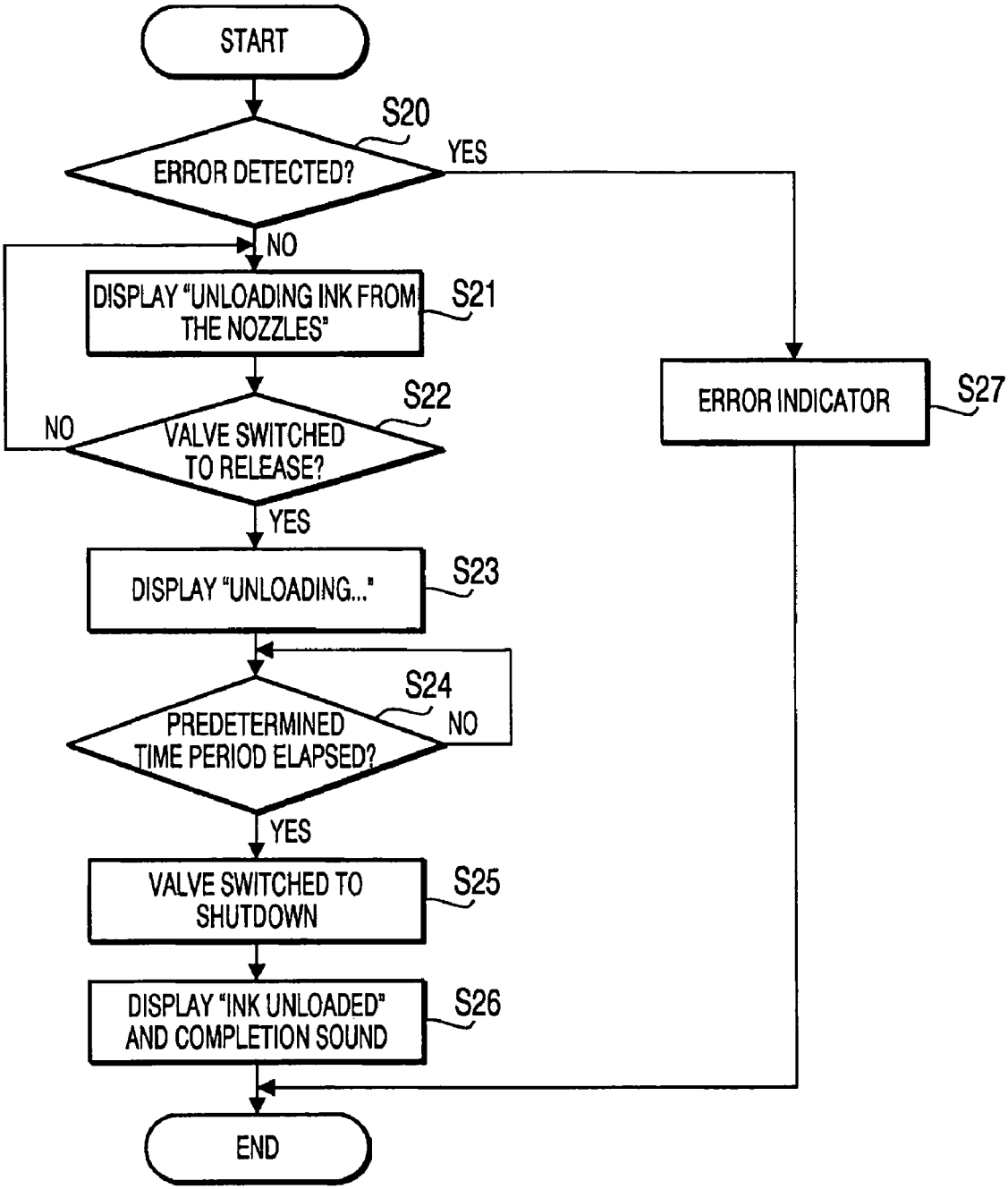
FIG. 8 is a flowchart to illustrate an ink withdrawal operation to be executed in the inkjet printer according to the embodiment of the present invention.

Next, the ink withdrawal operation in the inkjet printer 1 according to the present embodiment will be described with reference to FIGS. 7A, 7B, and 8. FIGS. 7A and 7B are diagrams to illustrate the operation indicator panel 28 in the inkjet printer 1 according to the embodiment of the present invention. FIG. 8 is a flowchart to illustrate the ink withdrawal operation to be executed in the inkjet printer 1 according to the embodiment of the present invention.

The operation indicator panel 28 in the inkjet printer 1 according to the present embodiment includes the display 30, the print start key 29*a*, the cancel key 29*b*, the maintenance key 29*c*, a cursor (up) key 29*d*, a cursor (down) key 29*e*, and an OK key 29*f* When the maintenance key 29*c* is pressed, the display 30 shows a menu screen as shown in FIG. 7A. Specifically, menu options "Head Cleaning," "Test Print," and "Ink Unloading" are displayed. When the menu options are displayed, a background of an option being currently selected (i.e., "Head Cleaning" in FIG. 7A) is inverted. An option to be selected can be specified by up and down motions of a cursor, which can be shifted by the cursor (up) key 29*d* and the cursor (down) key 29*e*. Thus, when the option "Ink Unloading" is selected with the OK key 29*f*, the display 30 shows the option "Ink Unloading" inverted as shown in FIG. 7B, and the ink withdrawal operation is started.

Next, the ink withdrawal operation will be described with reference to FIG. 8. When the ink withdrawal operation starts, in S20, it is examined as to whether an error condition is detected in the inkjet printer 1. The error condition may include, for example, that the first ink cartridges 31 is not set in a predetermined set position. When an error condition is detected (S20: YES), in S27, the error indicator 30*b* is activated, and information to indicate the ink withdrawal is inexecutable is provided to the user. More specifically, the error indicator lamp is lit, and/or an error indicating sound is generated. Thereafter, the operation is terminated.

In S20, when no error condition is detected (S20: NO), in S21, a message (e.g., "Unloading ink from the nozzles.") to indicate the ink is to be withdrawn is presented in the display 30. Further, the air release valve 44 is switched to release the air flow in between the first inkjet heads 21 and the first ink cartridges 31 in the ink conveyer tubes 34. In S22, it is examined as to whether the air release valve 44 is switched to release the air flow. If the air release valve 44 is switched (S22: YES), in S23, a message (e.g., "Unloading . . . ") to indicate that the ink is being withdrawn is presented in the display 30. In S24, it is examined as to whether a predetermined time period, which is substantially long to withdraw the remaining ink from the ink conveyer tubes 34, has elapsed. When the predetermined time period elapses (S24: YES), in S25, the air release valve 44 is switched to shut down the air flow in the ink conveyer tubes 34. Thus, because the air release valve 44 is switched to shut down the air flow in the ink conveyer tubes 34 after the predetermined time period, the inner surface of the ink conveyer tubes 34 is prevented from being exposed to open air so that even the minimum amount of ink remaining in the ink conveyer tubes 34 should not be dried out.

In S26, a message (e.g., "Ink withdrawn") to indicate completion of the ink withdrawal is presented in the display 30. In this regard, predetermined sound to indicate the completion of the ink withdrawal can be generated optionally. The operation is terminated thereafter.

According to the above operation, the ink remaining in the ink conveyer tubes 34 can be withdrawn and collected in the first ink cartridges 31 by utilizing the water head difference. Once the ink is collected, the ink can be stirred when the first ink cartridges 31 are removed from the inkjet printer 1 and shaken. When the first ink cartridges 31 containing the stirred ink are set again in the inkjet printer 1, the well-conditioned white ink can be ejected smoothly from the nozzles, and the remaining ink can be prevented from being wasted. According to the above configuration, removal of the ink conveyer tubes 34 in order to collect the remaining ink is not required, or branch structures to collect the remaining ink are not specifically required in the ink conveyer tubes 34.

Figures 9A, 9B:
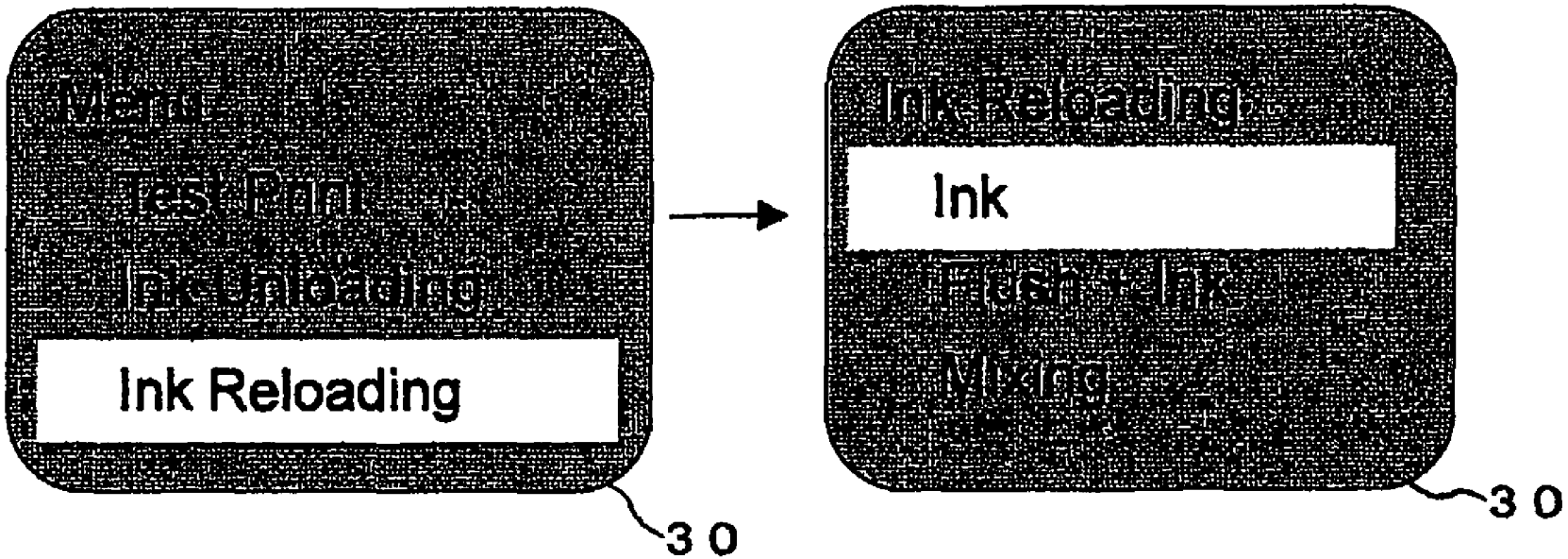
FIGS. 9A and 9B are diagrams to illustrate the operation indicator panel during an ink reloading operation in the inkjet printer according to the embodiment of the present invention.
Figure 10:
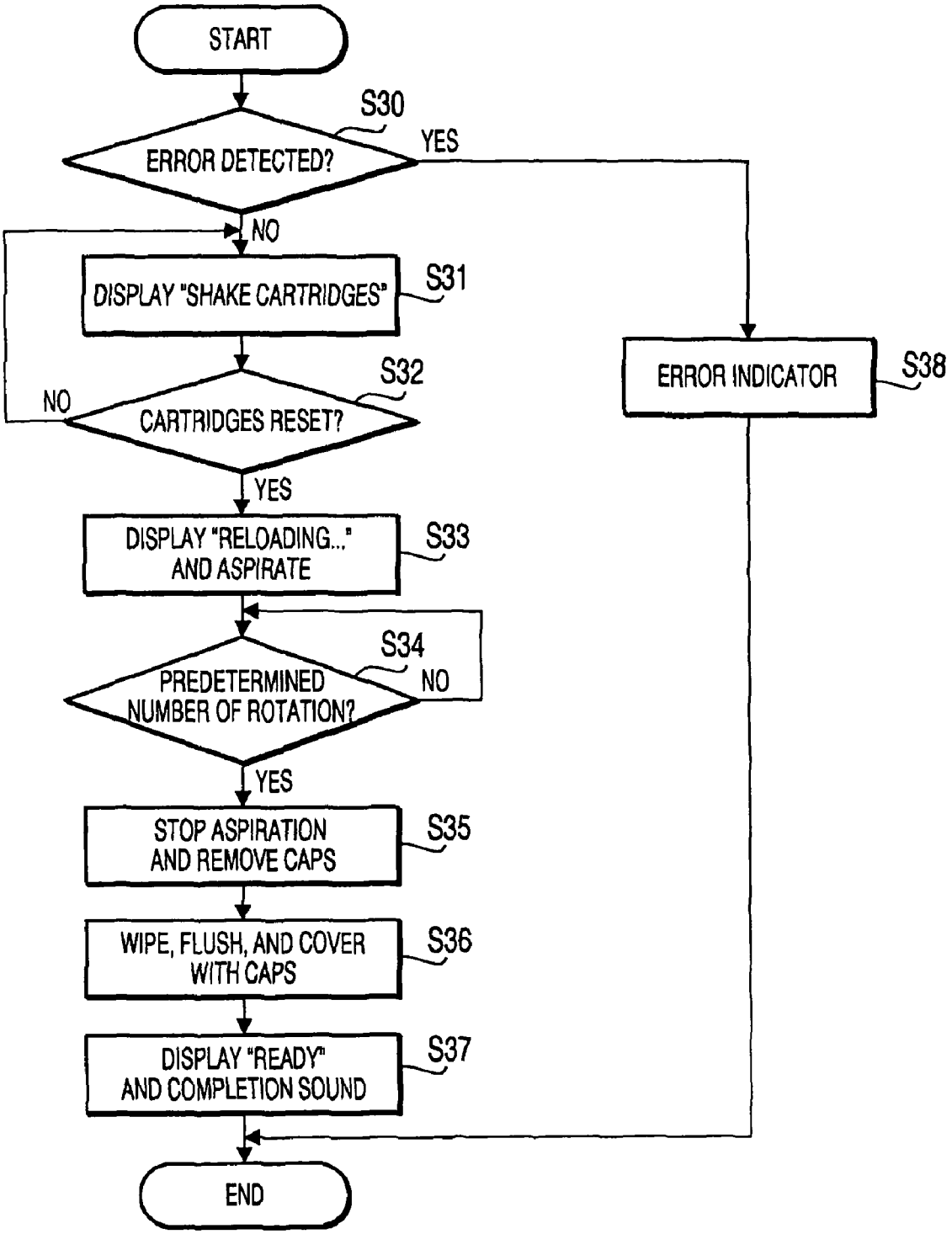
FIG. 10 is a flowchart to illustrate the ink reloading operation to be executed in the inkjet printer according to the embodiment of the present invention.

Next, an ink reloading operation in the inkjet printer 1 according to the present embodiment will be described with reference to FIGS. 9A, 9B, and 10. FIGS. 9A and 9B are diagrams to illustrate the operation indicator panel 28 during the ink reloading operation in the inkjet printer 1 according to the embodiment of the present invention. FIG. 10 is a flowchart to illustrate the ink reloading operation to be executed in the inkjet printer 1 according to the embodiment of the present invention.

When the operation indicator panel 28 presents the screen shown in FIG. 7A, and a user operates the cursor (down) key 29*e* to select a menu option "Ink Reloading," as shown in FIG. 9A, the "Ink Reloading" option is selected, and a screen presenting a submenu as shown in FIG. 9B is presented. When the OK key 29*f* is operated with the cursor on "Ink" option, the ink reloading operation is started.

The ink reloading operation will be described with reference to FIG. 10. When the ink reloading operation starts, in S30, it is examined as to whether an error condition is detected in the inkjet printer 1. When an error condition is detected (S30: YES), in S38, the error indicator 30*b* is activated, and information to indicate the ink reloading is inexecutable is provided to the user. More specifically, the error indicator lamp is lit, and/or an error indicating sound is generated. Thereafter, the operation is terminated.

In S30, if no error condition is detected (S30: NO), in S31, a message (e.g., "Shake the cartridges") to prompt the user to shake the first ink cartridges 31 is presented on the screen of the display 30. Thereafter, in S32, it is examined as to whether the first ink cartridges 31 are placed back in the predetermined set position in the inkjet printer 1. When the first ink cartridge 31 being set in the predetermined set position is detected (S32: YES), in S33, a message (e.g., "Reloading . . . ") to indicate that the ink is reloaded in the ink conveyer tubes 34 is presented in the display 30. Further, the ink is reloaded in the ink conveyer tubes 34. More specifically, the first inkjet heads 21 are moved to a predetermined maintenance position, in which the nozzle surfaces of the first inkjet heads 21 are covered with the caps 45 and the ink is drawn from the first ink cartridges 31. The caps 45 are connected to an aspirator (see FIGS. 4A, 4B) which aspirates through the nozzle surfaces of the first inkjet heads 21 so that the ink in the first ink cartridges 31 is drawn through the ink conveyer tubes 34 to the first inkjet heads 21. In this regard, it is to be noted that the ink can be aspirated from the first ink cartridges 31 through the ink conveyer tubes 34 even when the air release valve 44 is in the closed position to shut down the air flow.

When the ink conveyer tubes 34 and the first inkjet heads 21 are reloaded, an amount of the ink to be aspirated is smaller than an amount of the ink loaded in the ink conveyer tubes 34 for the first time. This is because a small amount of ink remains in the ink conveyer tubes 34 and the first inkjet heads 21, and fluid resistance in the ink conveyer tubes 34 and the first inkjet heads 21 is smaller. Therefore, upon reloading, an amount of the ink to be aspirated is adjusted to be smaller so that an amount of the ink to be wasted is reduced.

More specifically, in S34, it is examined as to whether the first maintenance motor 41 has rotated for a predetermined number of times, which is smaller than a number of times of rotation for the first maintenance motor 41 to initially load the ink. When the number of times of rotation reached to the predetermined number (S34: YES), in S35, the first maintenance motor 41 is stopped to cease aspiration. Further, the caps 45 are removed from the nozzle surfaces. In S36, the nozzle surfaces are wiped, the ink is flushed out of the nozzle surfaces, and the nozzle surfaces are covered with the caps 45. In S37, a message (e.g., "Ready") to indicate that the inkjet printer 1 is ready for a printing operation is presented in the screen of the display 30. In this regard, predetermined sound to indicate the completion of the ink reloading can be generated optionally. The operation is terminated thereafter.

According to the above operation, the ink collected in the first ink cartridges 31 can be reloaded in the ink conveyer tubes 34 and the first inkjet heads 21 to be used, and an amount of the ink to be wasted can be reduced.

Next, a cleaning and ink reloading operation in the inkjet printer 1 according to the present embodiment will be described with reference to FIGS. 11A, 11B, and 12.

Figures 11A, 11B:
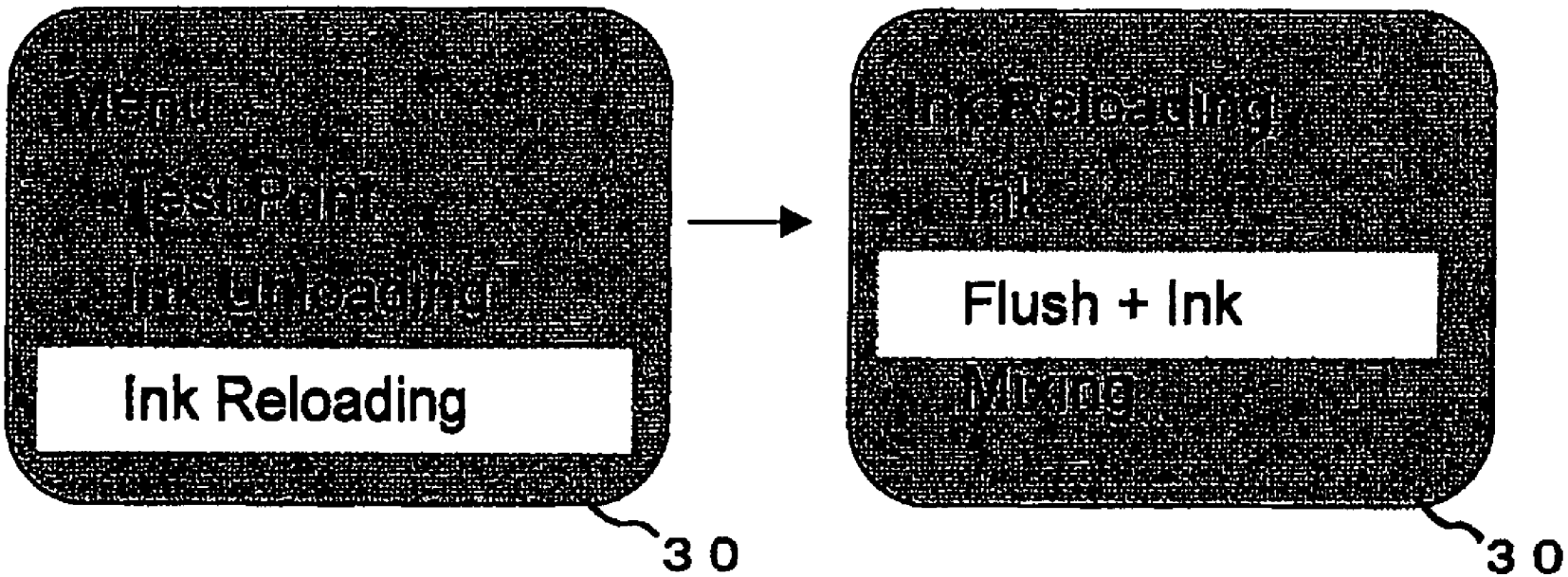
FIGS. 11A and 11B are diagrams to illustrate the operation indicator panel during a cleaning and ink reloading operation in the inkjet printer according to the embodiment of the present invention.
Figure 12:
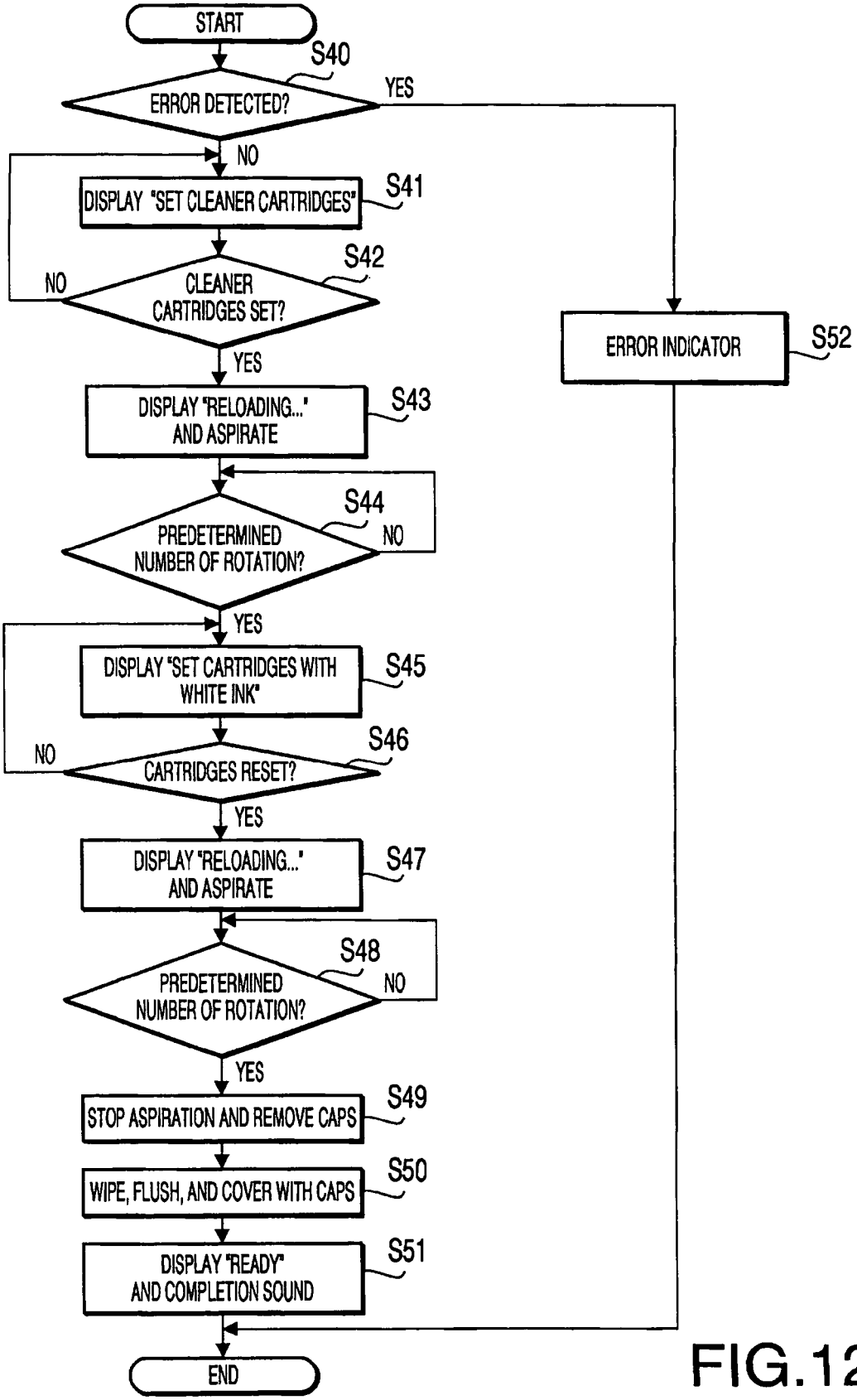
FIG. 12 is a flowchart to illustrate the cleaning and ink reloading operation to be executed in the inkjet printer according to the embodiment of the present invention.

FIGS. 11A and 11B are diagrams to illustrate the operation indicator panel 28 during the cleaning and ink reloading operation in the inkjet printer 1 according to the embodiment of the present invention. FIG. 12 is a flowchart to illustrate the cleaning and ink reloading operation to be executed in the inkjet printer 1 according to the embodiment of the present invention.

When the operation indicator panel 28 presents the screen shown in FIG. 7B, and the user operates the cursor (down) key 29*e* to select a menu option "Ink Reloading," as shown in FIG. 11A, the "Ink Reloading" option is selected, and a screen presenting a submenu as shown in FIG. 11B is presented. When the OK key 29*f* is operated with the cursor on "Flush+ ink" option, the cleaning and ink reloading operation is started.

The cleaning and ink reloading operation will be described with reference to FIG. 12. When the cleaning and ink reloading operation starts, in S40, it is examined as to whether an error condition is detected in the inkjet printer 1. When an error condition is detected (S40: YES), in S52, the error indicator 30*b* is activated, and information to indicate the ink reloading is inexecutable is provided to the user. More specifically, the error indicator lamp is lit, and/or an error indicating sound is generated. Thereafter, the operation is terminated.

In S40, if no error condition is detected (S40: NO), in S41, a message (e.g., "Set cleaner cartridges") to prompt the user to set cleaner cartridges (not shown), which contain cleaner liquid, in the inkjet printer 1 is presented on the screen of the display 30. Thereafter, in S42, it is examined as to whether the cleaner cartridges are placed in the predetermined set position in the inkjet printer 1. When the cleaner cartridges being set in the predetermined set position is detected (S42: YES), in S43, a message (e.g., "Reloading . . . ") to indicate that the cleaner liquid is loaded in the ink conveyer tubes 34 is presented in the display 30. Further, the cleaner liquid is loaded in the ink conveyer tubes 34. More specifically, the first inkjet heads 21 are moved to a predetermined maintenance position, in which the nozzle surfaces of the first inkjet heads 21 are covered with the caps 45 and the cleaner liquid is drawn from the cleaner cartridges.

In this regard, when the ink conveyer tubes 34 and the first inkjet heads 21 are loaded, an amount of the cleaner liquid to be aspirated is smaller than an amount of the ink loaded in the ink conveyer tubes 34 for the first time. This is because a small amount of ink remains in the ink conveyer tubes 34 and the first inkjet heads 21, and fluid resistance in the ink conveyer tubes 34 and the first inkjet heads 21 is smaller. Therefore, upon loading the cleaner liquid, an amount of the cleaner liquid to be aspirated is adjusted to be smaller so that an amount of the cleaner liquid to be wasted is reduced.

More specifically, in S44, it is examined as to whether the first maintenance motor 41 has rotated for a predetermined number of times, which is smaller than a number of times of rotation for the first maintenance motor 41 to initially load the ink. When the number of times of rotation reached to the predetermined number (S44: YES), in S45, the first maintenance motor 41 is stopped to cease aspiration. Further, a message (e.g., "Set cartridges with white ink") to prompt the user to set the first ink cartridges 31 containing white ink in the predetermined set position is presented on the screen of the display 30.

In S46, it is examined as to whether the first ink cartridges 31 are placed back in the predetermined set position in the inkjet printer 1. When the first ink cartridge 31 being set in the predetermined set position is detected (S46: YES), in S47, a message (e.g., "Reloading . . . ") to indicate that the ink is reloaded in the ink conveyer tubes 34 is presented in the display 30. Further, the ink is reloaded in the ink conveyer tubes 34. More specifically, the first inkjet heads 21 are moved to a predetermined maintenance position, in which the nozzle surfaces of the first inkjet heads 21 are covered with the caps 45 and the ink is drawn from the first ink cartridges 31.

In this regard, when the ink conveyer tubes 34 and the first inkjet heads 21 are reloaded, an amount of the ink to be aspirated is smaller than an amount of the ink loaded in the ink conveyer tubes 34 for the first time. More specifically, in S48, it is examined as to whether the first maintenance motor 41 has rotated for a predetermined number of times, which is smaller than a number of times of rotation for the first maintenance motor 41 to initially load the ink. When the number of times of rotation reached to the predetermined number (S48: YES), in S49, the first maintenance motor 41 is stopped to cease aspiration. Further, the caps 45 are removed from the nozzle surfaces. In 50, the nozzle surfaces are wiped, the ink is flushed out of the nozzle surfaces, and the nozzle surfaces are covered with the caps 45. In S51, a message (e.g., "Ready") to indicate that the inkjet printer 1 is ready for a printing operation is presented in the screen of the display 30. In this regard, predetermined sound to indicate the completion of the ink reloading can be generated optionally. The operation is terminated thereafter.

According to the above operation, the ink remaining in the ink conveyer tubes 34 can be removed to clean the ink conveyer tubes 34. The ink collected in the first ink cartridges 31 can be reloaded in the ink conveyer tubes 34 and the first inkjet heads 21 to be used. Thus, the inkjet printer 1 can be operated with the ink conveyer tubes 34 and the first inkjet heads 21 in a cleaned condition.

Next, an ink stirring operation in the inkjet printer 1 according to the present embodiment will be described with reference to FIGS. 13A, 13B, and 14.

Figure 13A:
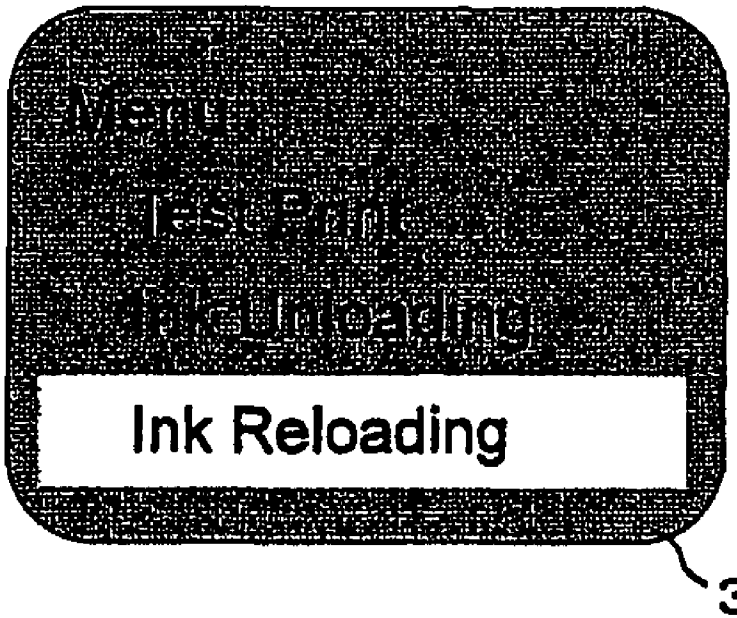
FIGS. 13A and 13B are diagrams to illustrate an ink stirring operation to be executed in the inkjet printer according to the embodiment of the present invention.
Figure 13B:
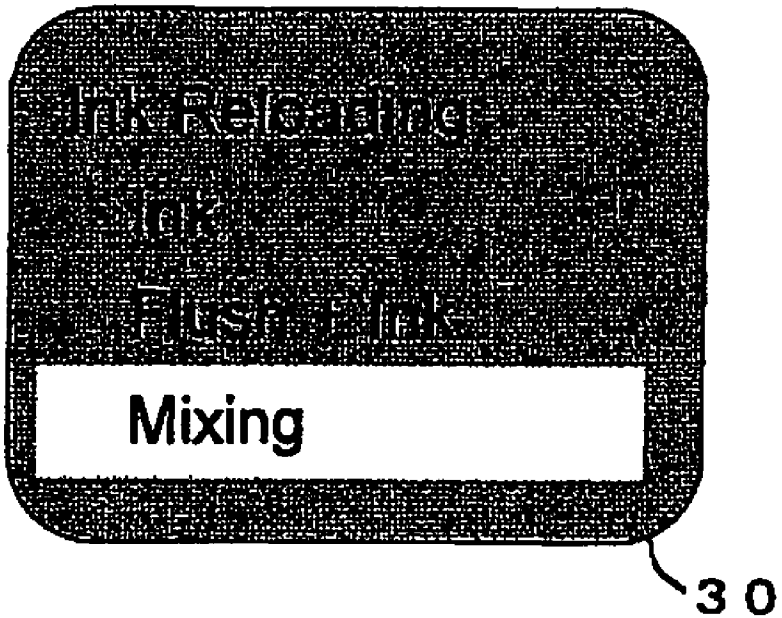
Figure 14:
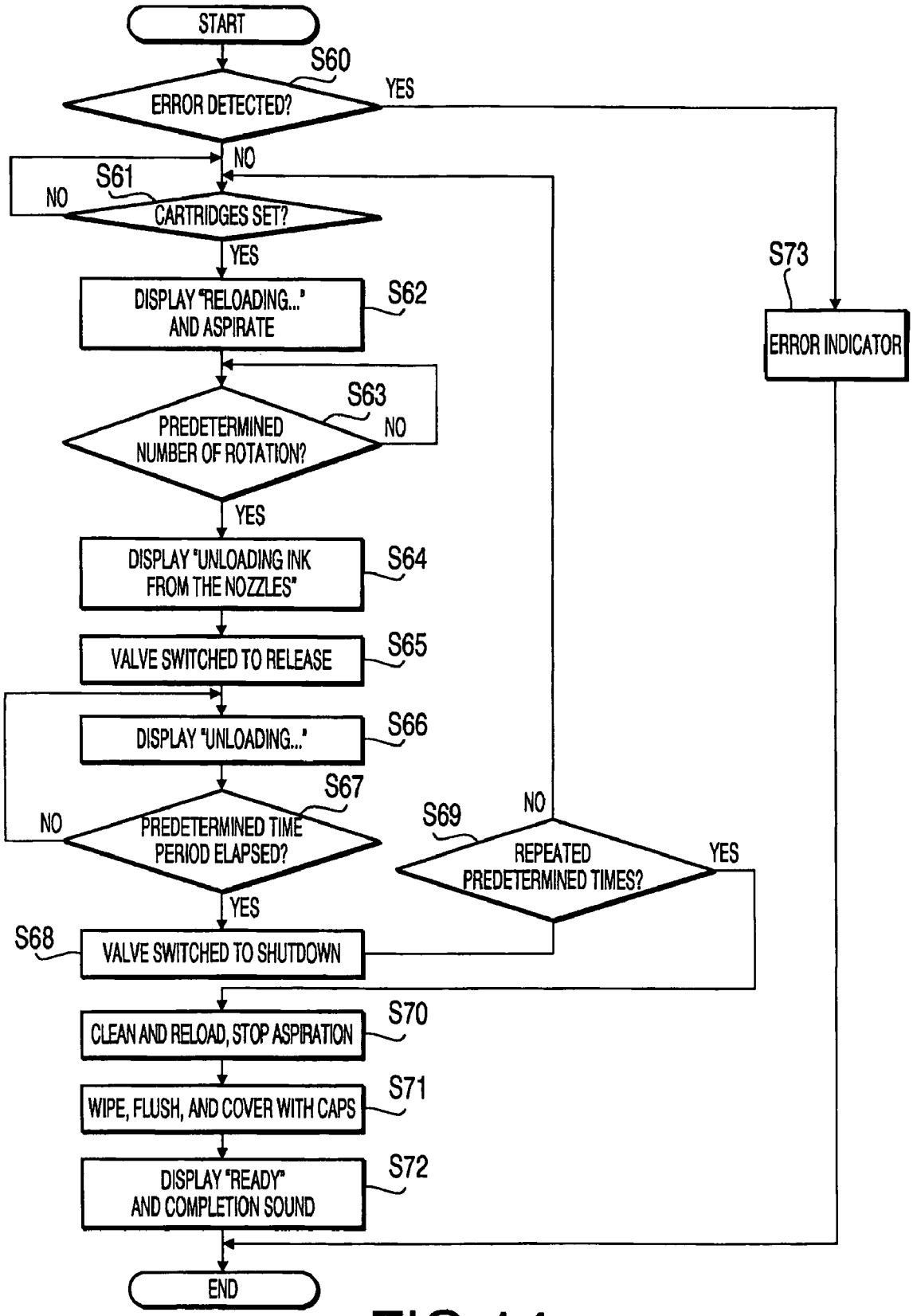
FIG. 14 is a flowchart to illustrate the ink stirring operation to be executed in the inkjet printer according to the embodiment of the present invention.

FIGS. 13A and 13B are diagrams to illustrate an ink stirring operation to be executed in the inkjet printer 1 according to the embodiment of the present invention. FIG. 14 is a flowchart to illustrate the ink stirring operation to be executed in the inkjet printer 1 according to the embodiment of the present invention.

When the operation indicator panel 28 presents the screen shown in FIG. 7B, and the user operates the cursor (down) key 29*e* to select a menu option "Ink Reloading," as shown in FIG. 13A, the "Ink Reloading" option is selected, and a screen presenting a submenu as shown in FIG. 13B is presented. When the OK key 29*f* is operated with the cursor on "Mixing" option, the stirring operation is started.

The stirring operation will be described with reference to FIG. 14. When the stirring operation starts, in S60, it is examined as to whether an error condition is detected in the inkjet printer 1. When an error condition is detected (S60: YES), in S73, the error indicator 30*b* is activated, and information to indicate the ink reloading is inexecutable is provided to the user. More specifically, the error indicator lamp is lit, and/or an error indicating sound is generated. Thereafter, the operation is terminated.

In S60, if no error condition is detected (S60: NO), in S61, it is examined as to whether the first ink cartridges 31 are placed in the predetermined set position in the inkjet printer 1. When the first ink cartridges 31 being set in the predetermined set position is detected (S61: YES), in S62, a message (e.g., "Reloading . . . ") to indicate that the ink is reloaded in the ink conveyer tubes 34 is presented in the display 30. Further, the ink is reloaded in the ink conveyer tubes 34. More specifically, the first inkjet heads 21 are moved to a predetermined maintenance position, in which the nozzle surfaces of the first inkjet heads 21 are covered with the caps 45 and the ink is drawn from the first ink cartridges 31.

In this regard, the amount of the ink to be aspirated is smaller than the amount of the ink loaded in the ink conveyer tubes 34 for the first time so that an amount of the ink to be wasted is reduced.

Therefore, in S63, it is examined as to whether the first maintenance motor 41 has rotated for the predetermined number of times, which is smaller than the number of times of rotation for the first maintenance motor 41 to initially load the ink. When the number of times of rotation reached to the predetermined number (S63: YES), the first maintenance motor 41 is stopped to cease aspiration. Thus, the ink conveyer tubes 34, from which the remaining ink has been once withdrawn, are reloaded.

In the stirring operation, next, the ink reloaded in the ink conveyer tubes 34 is once again withdrawn. More specifically, in S64, a message (e.g., "Unloading ink from the nozzles.") to indicate the ink is to be withdrawn is presented in the display 30. In S65, the air release valve 44 is switched to release the air flow in between the first inkjet heads 21 and the first ink cartridges 31 in the ink conveyer tubes 34. In S66, a message (e.g., "Unloading . . . ") to indicate that the ink is being withdrawn is presented in the display 30. In S67, it is examined as to whether the predetermined time period, which is substantially long to withdraw the remaining ink from the ink conveyer tubes 34, has elapsed. When the predetermined time period elapses (S67: YES), in S68, the air release valve 44 is switched to shut down the air flow in the ink conveyer tubes 34. Thus, the recollecting operation of the ink is terminated.

In the stirring operation according to the present embodiment, the ink reloading operation (S61-S63) and the ink recollecting operation (S64-S68) are repeated for a predetermined times (e.g., three times). Therefore, in S69, it is examined as to whether the above steps (S61-64) have been repeated for three times. If the steps S61-64 have not been repeated for three times (S69: NO), the process returns to S61 to repeat the steps S61-S64. When the steps S61-S64 have been repeated for three times (S69: YES), the process proceeds to S70, which corresponds to the operation in the steps S40-S48 in the cleaning and ink reloading operation shown in FIG. 12. It is to be noted that the predetermined times for the ink reloading operation and the ink recollecting operation are repeated is not limited to three, but may be twice, or four times or more.

When the cleaning and ink reloading operation is completed, in S71, the nozzle surfaces of the inkjet heads 21 are wiped, the ink is flushed out of the nozzle surfaces, and the nozzle surfaces are covered with the caps 45. In S72, a message (e.g., "Ready") to indicate that the inkjet printer 1 is ready for a printing operation is presented in the screen of the display 30. In this regard, predetermined sound to indicate the completion of the ink reloading can be generated optionally. The stirring operation is terminated thereafter.

According to the stirring operation as described above, the ink is reloaded and withdrawn repeatedly in the ink conveyer tubes 34; therefore, the white ink in the first inkjet heads 21 and the ink conveyer tubes 34 can be stirred. Accordingly, uneven concentration of the colorant in the white ink can be prevented from occurring, and concentration gradient of the white ink within the ink conveyer tubes 34 and the first inkjet heads 21 can be sustained to be smaller.

Although an example of carrying out the invention has been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 15B:
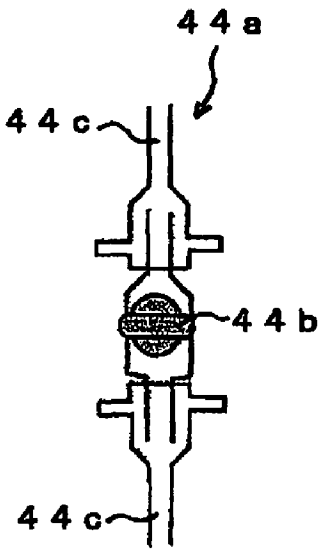
FIGS. 15A and 15B are diagrams to illustrate manually-operable release valves according to the embodiment of the present invention.
Figure 15A:
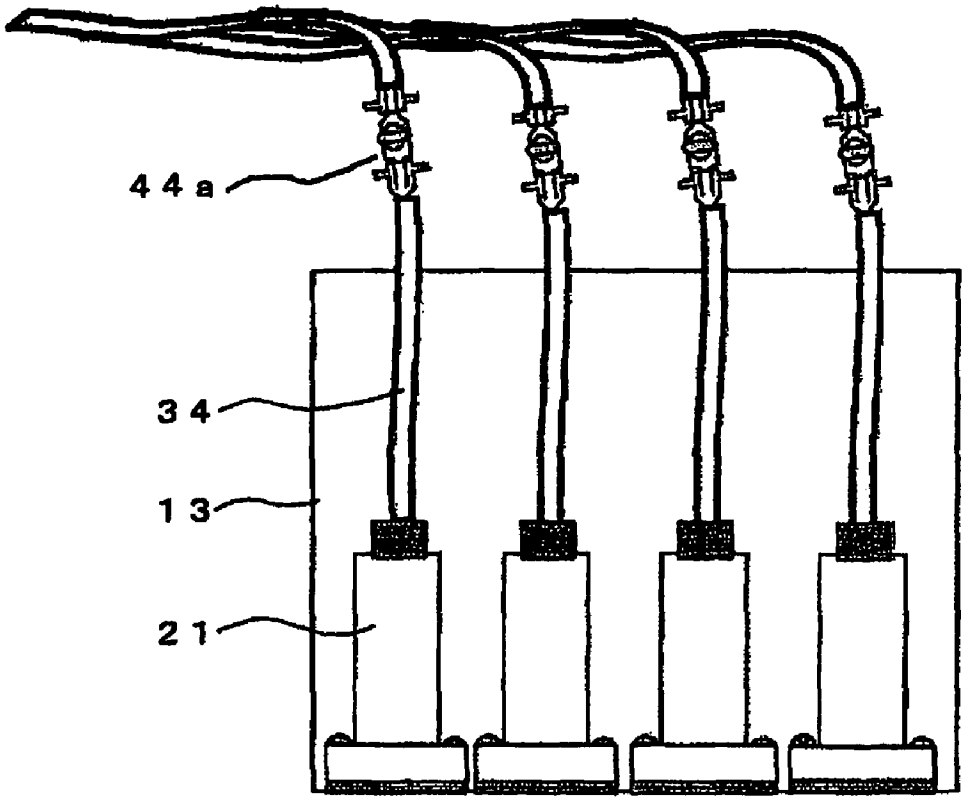

For example, the air release valve 44 may not necessarily be an electromagnetic valve, but may be a manually-operable valve. FIG. 15A illustrates manually-operable valves 44a provided in the ink conveyer tubes 34. FIG. 15B is an enlarged view of one of the manually-operable valves 44*a*. As shown in FIG. 15B, the manually-operable valve 44*a* is provided with joint portions 44*c* and a knob 44*b* which can be rotated manually. When the knob 44*b* is in an orientation perpendicular to the ink conveyer tube 34, as shown in FIG. 15B, the valve 44*a* is closed to shut down the air flow in the ink conveyer tube 34. When the knob 44*b* is turned by the user to orient in parallel with the ink conveyer tube 34, the valve 44*a* is open so that the air in the ink conveyer tube 34 is released to flow. Accordingly, the ink remaining in the ink conveyer tube 34 is withdrawn in the first ink cartridge 31. The user is required to turn the knobs 44*b* in the orientation shown in FIG. 15B after a predetermined time period to shut down the air flow in the ink conveyer tubes 34. When the ink reloading operation is conducted, the user is required to confirm that the manually-operable valves 44*a* are in the releasing orientation prior to aspiration of the ink.

Thus, according to the manually-operable valves 44*a*, the ink remaining in the ink conveyer tubes 34 can be collected, and the ink conveyer tubes 34 can be reloaded with the ink without electricity or other larger-volumed equipment.

Figure 16A:
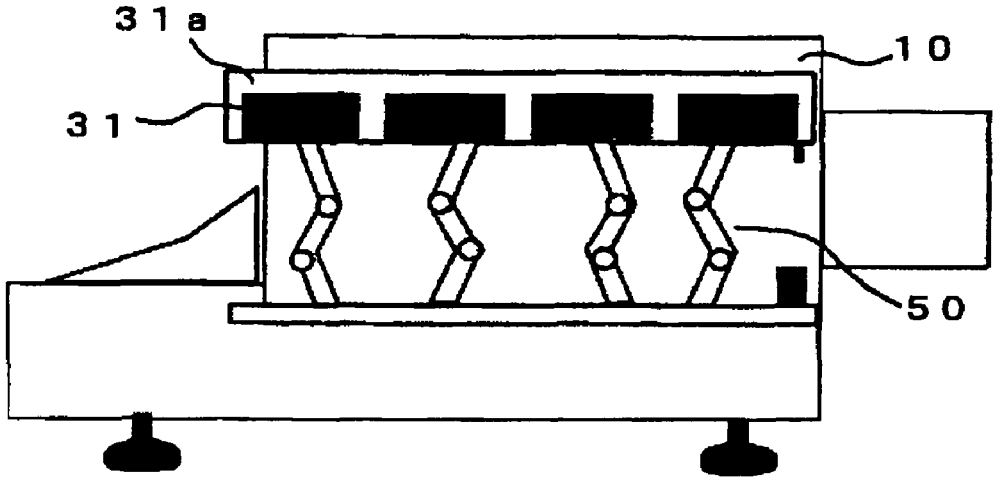
FIGS. 16A and 16B are diagrams to illustrate a descendible configuration in the inkjet printer according to the embodiment of the present invention.
Figure 16B:
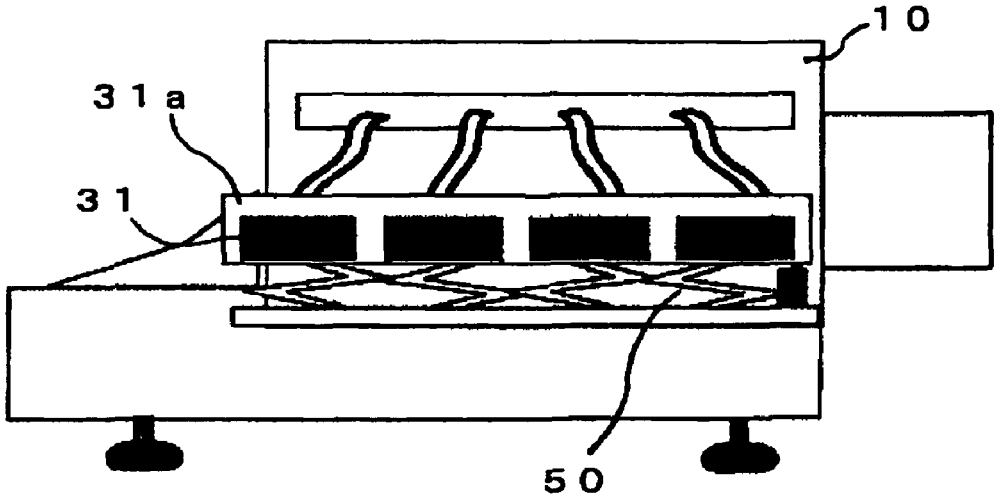

For another example, a descendible structure, which is for example configured with segmented arms to lower the position of the first ink cartridges 31, may be provided to the inkjet printer 1. FIGS. 16A and 16B are diagrams to illustrate a descendible mechanism 50 in the inkjet printer 1 according to the embodiment of the present invention. When the inkjet printer 1 is in a normal printing operation, an ink cartridge container 31*a* containing the first ink cartridges 31 is in an uplifted position with the segmented arms extended as shown in FIG. 16A. When the ink remaining in the ink conveyer tubes 34 is collected, the segmented arms are folded to descend the position of the position of the ink cartridge container 31 a in a lower position as shown in FIG. 16B.

According to the descending movement of the first ink cartridges 31, the water head difference in the ink conveyer tubes 34 is enlarged so that the ink can be collected in a shorter period of time. The descendible mechanism 50 may be manually or electrically driven.

In addition to the air release valve 44 in the ink conveyer tubes 34 for white ink, air release valves in a similar configuration can be provided to the ink conveyer tubes 35 for the CMYK inks. Optionally or alternatively, a descendible mechanism similar to the descendible mechanism 50 can be provided to the second ink cartridges 32 for the CMYK inks.

Further, it is to be noted that the fluid releasing mechanism may be provided to other ink conveyer tubes to convey ink other than white ink, containing solid component which may be deposited in the ink, to prevent concentration gradient.

What is claimed is:

1. A printing apparatus to form an image on a recording medium according to print data representing the image, comprising:

a recording head, which ejects ink onto the recording medium;

an ink cartridge, which contains the ink therein;

an ink cartridge storage to store the ink cartridge;

an ink conveyer tube, which connects the recording head and the ink cartridge to convey the ink;

a maintenance system having an aspirator to aspirate the ink to be drawn in the recording head and the ink conveyer tube and a cap to cover a nozzle surface of the recording head when the ink in the recording head and the ink conveyer tube is aspirated; and a releasing system, which is arranged in the ink conveyer tube to switch an open state in which air flow in the ink conveyer tube is released and a closed state in which the air flow in the ink conveyer tube is shut down, the releasing system being arranged in a position higher than a position of the ink cartridge so that the releasing system and the ink cartridge have a predetermined water head difference therebetween, wherein:

the releasing system includes:

an electrically-operable valve to be switched between an open position and a closed position, and a valve controller to control switching motions of the electrically-operable valve, the valve controller controlling the electrically-operable valve to be in the open position to release the air flow in the ink conveyer tube so that the ink in the recording head and the ink conveyer tube is withdrawn into the ink cartridge, the valve controller controlling the electrically-operable valve to be in the closed position after the ink in the recording head and the ink conveyer tube is withdrawn in the ink cartridge; and the maintenance system includes a maintenance controller, which controls the cap to cover the nozzle surface of the recording head and the ink in the recording head and the ink conveyer tube to be aspirated when the valve controller switches the electrically-operable valve to be in the closed position so that the air flow in the ink conveyer tube is shut down, and controls the cap to cover the nozzle surface of the recording head and the ink in the recording head and the ink conveyer tube to be aspirated so that the ink once withdrawn in the ink cartridges is drawn again in the recording head and the ink conveyer tube to be used.

2. The printing apparatus according to claim 1, wherein the predetermined water head difference between the releasing system and the ink cartridge is at least 20 mm.

3. The printing apparatus according to claim 1, wherein the releasing system includes a manually-operable valve.

4. The printing apparatus according to claim 1, wherein the valve controller controls the electrically-operable valve to be in the closed position when a predetermined time period elapses after the valve controller switched the electrically-operable valve to be in the open position.

5. The printing apparatus according to claim 1, wherein aspiration of the ink in the recording head and the ink conveyer tube by the maintenance system and the switching motions of the electrically-operable valve are repeated for a predetermined number of times so that the ink to be reloaded in the recording head and the ink conveyer tube is stirred in the ink cartridge.

6. The printing apparatus according to claim 1, wherein at least one filter to catch obstacles in the ink is provided in at least one of an upstream side and a downstream side of the releasing system.

7. The printing apparatus according to claim 1, wherein the ink contained in the ink cartridges is white-colored ink.

8. The printing apparatus according to claim 1, further comprising a descendible system to change the water head difference between the releasing system and the ink cartridge.

9. The printing apparatus according to claim 8, wherein the descendible system changes a vertical position of ink cartridge to be lower than a vertical position of the releasing system so that the water head difference between the releasing system and the ink cartridge is enlarged when releasing system is in the open state and the air flow in the ink conveyer tube is released.

10. A printing apparatus to form an image on a recording medium according to print data representing the image, comprising:

a recording head, which ejects ink onto the recording medium;

an ink cartridge, which contains the ink therein;

an ink cartridge storage to store the ink cartridge;

an ink conveyer tube, which connects the recording head and the ink cartridge to convey the ink;

a maintenance system having an aspirator to aspirate the ink to be drawn in the recording head and the ink conveyer tube and a cap to cover a nozzle surface of the recording head when the ink in the recording head and the ink conveyer tube is aspirated; and a releasing system, which is arranged in the ink conveyer tube to switch an open state in which air flow in the ink conveyer tube is released and a closed state in which the air flow in the ink conveyer tube is shut down, the releasing system being arranged in a position higher than a position of the ink cartridge so that the releasing system and the ink cartridge have a predetermined water head difference therebetween, wherein:

the releasing system includes:

an electrically-operable valve to be switched between an open position and a closed position, and a valve controller to control switching motions of the electrically-operable valve, the valve controller controlling the electrically-operable valve to be in the open position to release the air flow in the ink conveyer tube so that the ink in the recording head and the ink conveyer tube is withdrawn into the ink cartridge, and the maintenance system includes a maintenance controller, which controls the cap to cover the nozzle surface of the recording head and the ink in the recording head and the ink conveyer tube to be aspirated when the valve controller switches the electrically-operable valve to be in the closed position so that the air flow in the ink conveyer tube is shut down, and wherein an amount of the ink to be reloaded in the ink conveyer tube and the recording head is smaller than an amount of the ink having been loaded initially in the ink conveyer tube and the recording head when the maintenance system reloads the recording head with the ink drawn from the ink cartridges.

11. The printing apparatus according to claim 10, wherein the predetermined water head difference between the releasing system and the ink cartridge is at least 20 mm.

12. The printing apparatus according to claim 10, wherein the releasing system includes a manually-operable valve.

13. The printing apparatus according to claim 10, wherein the valve controller controls the electrically-operable valve to be in the closed position when a predetermined time period elapses after the valve controller switched the electrically-operable valve to be in the open position.

14. The printing apparatus according to claim 10, wherein aspiration of the ink in the recording head and the ink conveyer tube by the maintenance system and the switching motions of the electrically-operable valve are repeated for a predetermined number of times so that the ink to be reloaded in the recording head and the ink conveyer tube is stirred in the ink cartridge.

15. The printing apparatus according to claim 10, wherein at least one filter to catch obstacles in the ink is provided in at least one of an upstream side and a downstream side of the releasing system.

16. The printing apparatus according to claim 10, wherein the ink contained in the ink cartridges is white-colored ink.

17. The printing apparatus according to claim 10, further comprising a descendible system to change the water head difference between the releasing system and the ink cartridge.

18. The printing apparatus according to claim 17, wherein the descendible system changes a vertical position of ink cartridge to be lower than a vertical position of the releasing system so that the water head difference between the releasing system and the ink cartridge is enlarged when releasing system is in the open state and the air flow in the ink conveyer tube is released.

* * * * *